US006758179B1

(12) United States Patent
McKay et al.

(10) Patent No.: US 6,758,179 B1
(45) Date of Patent: Jul. 6, 2004

(54) METHOD AND APPARATUS FOR CONTROLLING A VARIABLE VALVE SYSTEM FOR AN INTERNAL COMBUSTION ENGINE

(75) Inventors: Daniel Lee McKay, Brighton, MI (US); Jeffrey M. Pfeiffer, Walled Lake, MI (US); Amanpal S. Grewal, Novi, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/375,513

(22) Filed: Feb. 26, 2003

(51) Int. Cl.[7] ..... F01L 1/34

(52) U.S. Cl. ..... 123/90.17; 123/90.15; 123/90.16

(58) Field of Search ..... 123/90.15–90.18, 123/90.27, 90.31, 347, 349, 355, 406.58, 406.59, 90.12; 324/384; 73/1.08, 1.19, 23.32, 862, 862.041, 862.08, 862.192, 232, 239, 248

(56) References Cited

U.S. PATENT DOCUMENTS

| | | | | |
|---|---|---|---|---|
| 5,056,476 | A | 10/1991 | King | 123/90.16 |
| 5,469,818 | A | 11/1995 | Yoshioka et al. | 123/90.15 |
| 5,570,621 | A | 11/1996 | Kabasin | 91/363 R |
| 5,680,834 | A * | 10/1997 | Szpak et al. | 123/90.15 |
| 6,006,725 | A * | 12/1999 | Stefanopoulou et al. | 123/399 |
| 6,367,462 | B1 | 4/2002 | McKay et al. | 123/568.21 |
| 6,488,008 | B1 * | 12/2002 | Jankovic et al. | 123/399 |
| 6,499,449 | B2 * | 12/2002 | Michelini et al. | 123/90.15 |

* cited by examiner

*Primary Examiner*—Thomas Denion
*Assistant Examiner*—Kyle Riddle
(74) *Attorney, Agent, or Firm*—Jimmy L. Funke

(57) ABSTRACT

The present invention provides a method and apparatus to control the rate of change of the variable cam phasing system during transient engine operating conditions. It does this primarily to maintain combustion stability. The invention controls the rate of change of the variable cam phasing system based upon the operating point of the engine, the desired operating point of the engine, and the rate of change of the variable cam phasing system necessary to maintain combustion stability.

11 Claims, 2 Drawing Sheets

METHOD AND APPARATUS FOR CONTROLLING A VARIABLE VALVE SYSTEM FOR AN INTERNAL COMBUSTION ENGINE

TECHNICAL FIELD

This invention pertains generally to variable valve systems for use in internal combustion engines, and more specifically to a method and apparatus to control the variable valve system during transient engine operations.

BACKGROUND OF THE INVENTION

Engine manufacturers incorporate variable valve systems, including variable cam phasing systems, to improve operating and emissions performance of internal combustion engines. Distinct engine operating characteristics resulting from use of the variable valve system include improved combustion stability at idle, improved airflow into the engine over a range of engine operations corresponding to improvements in engine performance, and improved dilution tolerance in a combustion charge. Benefits of incorporating the variable valve system into an engine include improved fuel economy, improved torque at low engine speeds, lower engine cost and improved quality through elimination of external exhaust gas recirculation (EGR) systems, and improved control of engine exhaust emissions.

A typical internal combustion engine is comprised of at least one cylinder containing a piston that is attached to a rotating crankshaft by a piston rod. The piston slides up and down the cylinder in response to combustion events that occur in a combustion chamber formed in the cylinder between the piston and a head. The head contains one or more intake valves to control the flow of air and fuel into the combustion chamber, and one or more exhaust valves that control the flow of exhaust gases out of the combustion chamber. A rotating camshaft opens and closes the intake and exhaust valves, and is synchronized with the position of each piston and the crankshaft. As an example of a variable valve system, a typical variable cam phasing system includes one or more variable cam phasers attached to an engine camshaft, and a cam position sensor that measures rotational position of each camshaft. The variable cam phasing system varies the opening and closing of each intake or exhaust valve by varying angular position and rotation of the camshaft, relative to angular position and rotation of the crankshaft and each respective cylinder. An oil control valve diverts pressurized engine oil to the variable cam phaser, primarily based upon feedback from the cam position sensor. Typically an electronic engine controller controls this operation.

Timing of the intake valve opening affects mass of air that flows into an individual cylinder, thus affecting volumetric efficiency of the internal combustion engine. This also affects fuel delivery, because fuel delivery is typically determined by measuring or calculating mass air flow and determining an air/fuel ratio that is required to meet operator performance requirements and engine emissions requirements. The quantity of fuel delivered to each cylinder is determined based upon the combination of mass airflow to the cylinder and the required air/fuel ratio. A combustion charge is created in each combustion chamber by delivering the quantity of fuel near the intake valve of the cylinder, or directly into the cylinder. This is known to one skilled in the art. When the mass airflow into the cylinder cannot be repeatably predicted because of an unpredictable position of the variable cam phaser, the fuel control system may overfuel or underfuel the combustion charge, leading to problems with combustion stability, and variations in air/fuel ratio that affect emissions and driveability.

The performance of the variable cam phasing system, in terms of response time and ability to maintain a position, is affected by several factors in the system. These factors include engine oil pressure and flow; oil viscosity, age and contamination; part-to-part variability caused by manufacturing tolerances and component wear; and engine operating temperature. These factors result in an inability of a controller to precisely determine position and response time of the variable cam phaser, especially during transient engine operation. The previously described benefits derived from use of the variable cam phasing system may be compromised due to variations in response times. An engine with dual cylinder banks may also experience differences between the two banks in terms of response time of each cam phaser that is caused by differences in oil pressure and flow at each bank. This may result in further reduced engine performance due to vibration and engine instability caused by variations in bank-to-bank airflow, individual cylinder fueling, and volumetric efficiencies.

By way of example, the engine controller uses the variable cam phaser on air intake valves to open each valve early in the intake stroke to improve volumetric efficiency at low engine speeds. The result is improved engine torque at low speeds, allowing for improved vehicle acceleration. In current variable cam phasing systems, the system is calibrated based upon a known set of engine operating factors and a limited quantity of components. The controller controls the cam phasing system and the closed-loop control system and compensates for air flow variation caused by the factors previously discussed (i.e. contamination, part-to-part variability, engine operating temperature, oil viscosity, and component wear) with feedback from the cam position sensor and exhaust gas sensors, under most operating conditions. However, when the engine is engaged in a transient maneuver such as acceleration or deceleration, the lag time associated with the feedback system limits the ability of the controller to compensate for inaccuracies in open-loop airflow estimates due to variation in transient response of the variable cam phaser. The unknown instantaneous volumetric efficiency related to the resulting lag time leads to incorrect fueling of individual cylinders as well as reduced EGR tolerance in the combustion charge. The result is increased engine-out emissions, reduced engine power, increased combustion instability, and increased potential for cylinder misfire, as described previously. The engine performance problems and compromises are further exacerbated when the cylinders of the engine are in a dual bank configuration with separate variable cam phasing hardware for each bank of cylinders, as described previously. Hence, there is a need for a method and system to compensate for variability of response of a variable cam phasing system during transient engine operation.

SUMMARY OF THE INVENTION

The present invention is an improvement over conventional engine systems that employ variable cam phasing in that it provides a method and apparatus to control the rate of change of the variable cam phasing system during transient engine operating conditions. The goal of the invention is primarily to maintain combustion stability. The method includes determining a rate of change of the variable cam phasing system substantially necessary to maintain combustion stability. It monitors an operating point of the engine, and determines a desired operating point of the engine. The invention controls the rate of change of the variable cam phasing system based upon the operating point of the engine, the desired operating point of the engine, and the rate of change of the variable cam phasing system necessary to maintain combustion stability. These and other objects of the invention will become apparent to those skilled in the art upon reading and understanding the following detailed description of the embodiments.

BRIEF DESCRIPTION OF THE DRAWINGS

The invention may take physical form in certain parts and arrangement of parts, and methods to control the parts. The preferred embodiment of the invention will be described in detail and illustrated in the accompanying drawings which form a part hereof, and wherein.

DETAILED DESCRIPTION OF AN EMBODIMENT OF THE INVENTION

Figure 1:
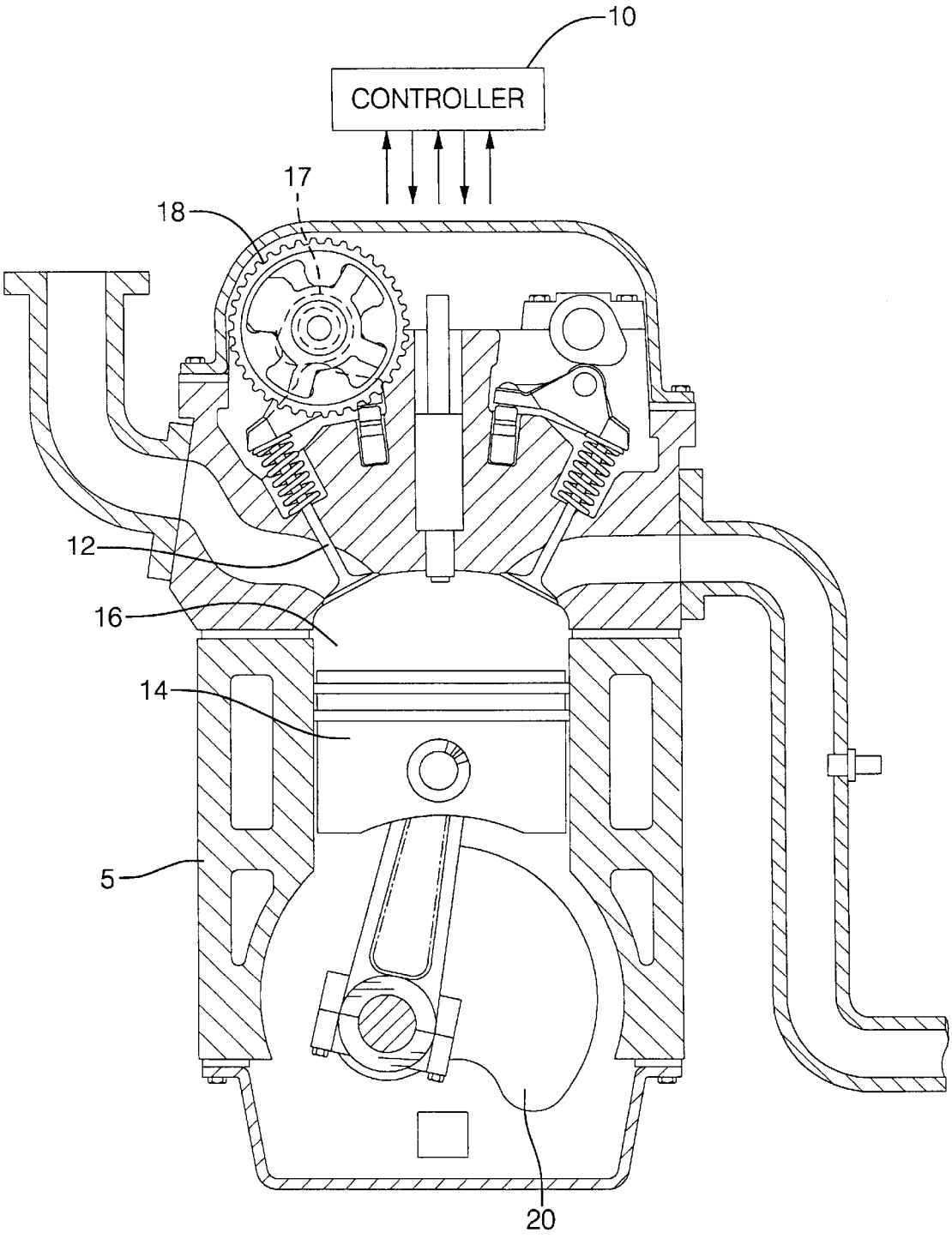
FIG. 1 is a schematic diagram of an engine with a variable cam phasing system, in accordance with the present invention; and, FIGS. 2A and 2B are graphs, in accordance with the present invention.

Referring now to the drawings, wherein the showings are for the purpose of illustrating an embodiment of the invention only and not for the purpose of limiting the same, FIG. 1 shows an internal combustion engine 5, controller 10 and variable cam phasing system which has been constructed in accordance with an embodiment of the present invention. The engine 5 has an intake camshaft 17 that rotates around an axis and is operable to open and close each intake valve 12 corresponding to each cylinder 16 of the engine 5. The intake camshaft 17 opens each intake valve 12 relative to a top-dead center point of a piston 14 in the corresponding cylinder 16. The opening of each intake valve 12 is measured in units of degrees of camshaft rotation before the top-dead center point, and is also correlated to a position of a crankshaft 20 that is operably attached to each piston 14. The variable cam phasing system controls the rotation of the intake camshaft 17, and hence the opening and corresponding closing of each intake valve 12 relative to the top-dead center point of each piston in each corresponding cylinder. The engine 5 with pistons, camshafts, crankshaft 20 and the controller 10 are well known to one skilled in the art.

A first embodiment, shown in FIG. 1 of the invention, comprises the engine 5 with a single bank of in-line cylinders and an intake camshaft operable to open and close each of the intake valves. In the first embodiment the variable cam phasing system is preferably comprised of a single vane-type variable cam phaser 18 operably attached to the intake camshaft 17, and fluidly connected to an oil control valve (not shown). The oil control valve controls the flow of pressurized engine oil to the vane-type variable cam phaser 18. A cam position sensor (not shown) is operable to measure degrees of camshaft rotation and is signally electrically connected to the controller 10. The controller 10 is operably connected to the oil control valve (not shown) and controls the flow of pressurized engine oil to the vane-type variable cam phaser 18, based upon the degrees of camshaft rotation as measured by the cam position sensor, and desired degrees of camshaft rotation, and as determined by internal control algorithms. The engine 5 with the variable cam phasing system and the controller 10 are well known to those skilled in the art.

A second embodiment of the invention (not shown) comprises the engine 5 configured with dual banks of in-line cylinders, said banks arranged in a V-configuration, and a first and a second camshaft (not shown). The first camshaft is operable to open and close each of the intake valves on a first bank of the engine 5. The second camshaft is operable to open and close each of the intake valves on a second bank of the engine 5. In this embodiment, the variable cam phasing system is preferably comprised of a first and a second vane-type variable cam phaser, each of which is operably attached to the first camshaft or the second camshaft, and each is fluidly connected to the oil control valve (not shown). The oil control valve controls the flow of pressurized engine oil to the first and the second vane-type variable cam phasers. A first cam position sensor (not shown) is operable to measure degrees of camshaft rotation of the first camshaft, and a second cam position sensor (not shown) is operable to measure degrees of camshaft rotation of the second camshaft. The first and second cam position sensors are signally electrically connected to the controller 10. The controller 10 is operably connected to the oil control valve and controls the flow of pressurized engine oil to the first and the second vane-type variable cam phasers, based upon the degrees of camshaft rotation as measured by the first and the second camshafts, and desired degrees of camshaft rotation, and as determined by internal control algorithms. The variable cam phasing system and the controller 10 for in-line engines and dual-bank engines are well known to those skilled in the art.

The controller 10 is also preferably operably attached to other sensors and output devices to monitor and control engine operation. The output devices preferably include subsystems necessary for proper control and operation of the engine, including a fuel injection system, a spark-ignition system, an electronic throttle control system, an exhaust gas recirculation system, and an evaporative control system (not shown). The sensors include devices operable to monitor engine operation, external conditions, and operator demand, and are electrically attached to the controller 10. The engine sensors preferably comprise the cam position sensor, an exhaust gas sensor, a crank speed sensor that measures engine speed, a manifold absolute pressure sensor for determining engine load, a throttle position sensor, a mass air flow sensor, and others (not shown). Other sensors preferably include an accelerator pedal position sensor, among others (not shown). The controller 10 controls operation of the engine 5 by collecting input from the sensors and controlling the output devices, using control algorithms and calibrations internal to the controller 10 and the various sensors. The use of the controller to control operation of the internal combustion engine using output devices, based upon input from various sensors, is well known to those skilled in the art.

The instant invention comprises a method and system for substantially controlling a rate of change of the variable cam phasing system of the internal combustion engine 5, especially during transient operation. Transient operation is defined as occurring when an operating point of the engine differs from a desired operating point of the engine 5. The invention includes providing a system wherein the rate of change of the variable cam phasing system substantially necessary to maintain combustion stability is determined. The operating point of the engine 5 is monitored, preferably by the controller 10, and the desired operating point is determined. The controller 10 is then operable to control the rate of change of the variable cam phasing system based upon the operating point of the engine, the desired operating point of the engine, and the rate of change of the variable cam phasing system substantially necessary to maintain combustion stability. The rate of change of the variable cam phasing system substantially necessary to maintain combustion stability is a calibratable value that is predetermined during engine development, and may also be adjusted during ongoing engine operation based upon engine operation.

The controller 10 is operable to monitor the operating point of the engine 5, based upon input from the sensors described previously. The operating point is a measure of engine output torque and speed, and preferably comprises an ongoing, real-time measurement of engine performance parameters including engine speed, engine load, and engine air/fuel ratio. The controller 10 preferably determines the operating point of the engine 5, based upon input from the aforementioned engine sensors. Determination of the operating point of an internal combustion engine using the controller is well known to those skilled in the art.

The controller 10 also determines a desired operating point, such as when there is a change in operator demand or a change in engine operation. The desired operating point comprises revised engine performance parameters that are necessary to meet the change in operator demand or engine operation. Examples of changes in operator demands primarily include vehicle acceleration or deceleration, and are based upon inputs from the accelerator pedal (not shown), a brake pedal (not shown), or a cruise control system (not shown). Examples of changes in engine operation that may cause the controller to change engine operation primarily include sudden changes in parasitic engine loads (e.g. due to a generator, a power steering pump, or an air conditioning compressor). They also include changes in operating conditions leading to changes in cruise control operation to maintain vehicle speed.

The initial rate of change of the variable cam phasing system substantially necessary to maintain combustion stability is a calibratable value that is preferably predetermined using a representative development engine during engine development phase prior to mass production. The development engine is preferably operably connected to an engine dynamometer for testing, and is instrumented to measure various operating conditions of the engine 5. The measured engine operating conditions include a coefficient of variation of mean effective pressure ("COV-IEP"), engine speed variation, and exhaust emissions. Test conditions comprise operating the engine at a series of specific operating points (speed, load, air/fuel ratio) and commanding the variable cam phasing system to change the degrees of camshaft rotation at several rates of changes, measured in cam angle degrees per second at each operating point. An example of ranges test conditions for specific operating points include engine speeds from idle to 3500 rpm, load from 0 to 80 kPa, and air/fuel ratio at +/−0.05% of stoichiometry. The rate of change includes advancing and retarding the cam angle as measured relative to each piston 14 at top-dead center. The engine operating conditions are measured during each of the test conditions. The maximum rate of change of the variable cam phasing system is determined by evaluating the measured engine operating conditions from each test condition. The maximum rate of change is selected wherein the measured engine operating conditions approach, but remain below allowable thresholds for COV-IMEP, engine speed, and exhaust emissions. The allowable thresholds for COV-IMEP, engine speed, and exhaust emissions are established based upon an evaluation of engine and emissions performance. The initial rate of change of the variable cam phasing system substantially necessary to maintain combustion stability is made equal to the maximum rate of change. The initial rate of change is a single value, or an array of values based upon different engine operating conditions and whether the cam angle is advancing or retarding. The initial rate of change is stored in the engine controller 10 as part of the calibration, as described previously. The initial rate of change necessary to maintain combustion stability is preferably a single maximum rate change of 50 degrees per second, and the variable cam phasing system cannot operate above that rate of change. Engine dynamometer testing and measurement of engine operating conditions, including COV-IMEP, engine speed, and exhaust emissions, are known to one skilled in the art.

The controller 10 is operable to change the initial rate of change of the variable cam phasing system during ongoing operation of the engine 5, preferably under warmed-up engine operating conditions. The controller uses the aforementioned sensors to monitor engine performance parameters during periods when the controller 10 is adjusting the variable cam phasing system, as measured in degrees of camshaft rotation. The monitored engine performance parameters are related to combustion stability, preferably including engine speed variation as measured by the crank speed sensor (not shown). The controller 10 preferably uses internal algorithms to determine an index of combustion stability that is based upon the engine speed variation. The controller 10 then preferably uses another internal algorithm to compare the index of combustion stability to a calibrated threshold for combustion stability, based upon the engine speed variation that was also determined during the engine dynamometer test described hereinabove. When the index of combustion stability exceeds the calibrated threshold for combustion stability, the controller 10 adjusts the rate of change of the variable cam phasing system to maintain the combustion stability. The controller preferably stores, the adjusted rate of change of the variable cam phasing system for subsequent use by the controller 10 in controlling the variable cam phasing system. Use of algorithms and calibrations in the controller 10 to operate an internal combustion engine, including determination of engine speed variation, is well known to those skilled in the art.

Figure 2A:
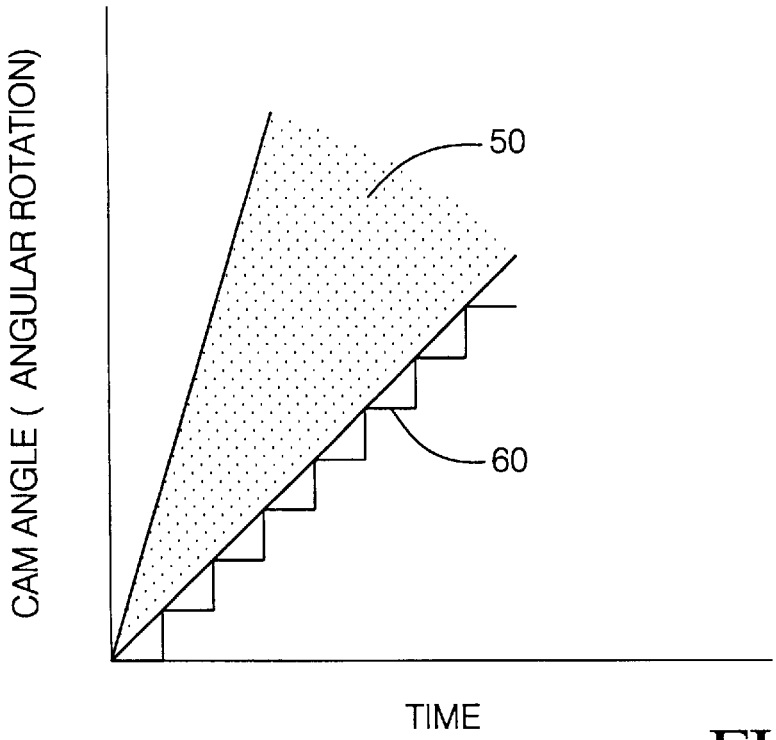

Referring now to FIG. 2A, a first example of an initial calibration, in the form of a graph with a rate of change of the variable cam phasing system as a function of time, is shown for the first embodiment. The area identified as 50 is representative of maximum rates of change substantially necessary to maintain combustion stability, measured in cam angle degrees per second, over the range of test conditions mentioned previously. A line 60 is identified to be the initial rate of change substantially necessary to maintain combustion stability, for the first embodiment. A calibration representing the values of the line 60 is included in the controller 10 for this embodiment as the initial rate of change of the variable cam phasing system substantially necessary to maintain combustion stability. Calibration of the controller is known to one skilled in the art.

Figure 2B:
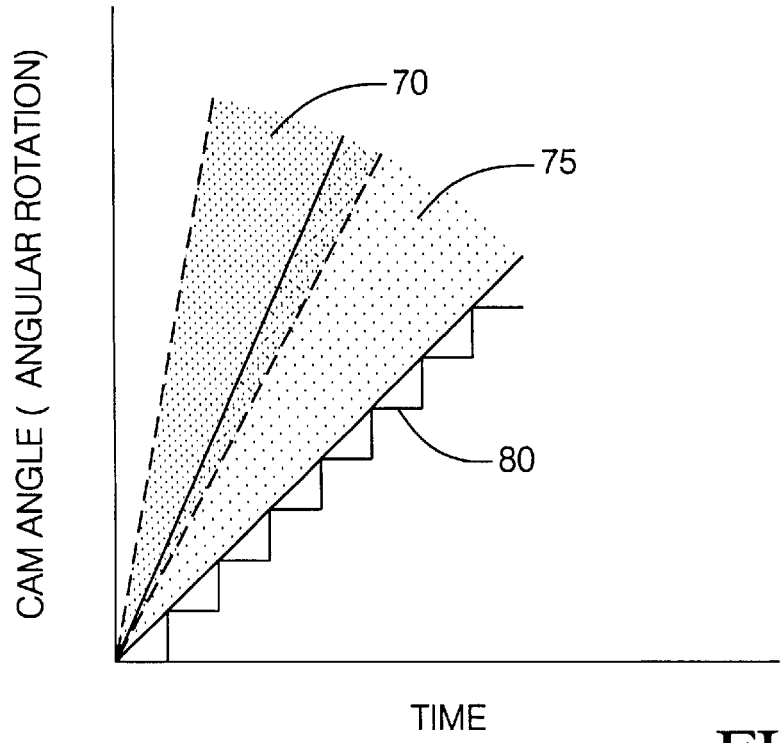

Referring now to FIG. 2B, a second example, in the form of a graph with a rate of change of the variable cam phasing system as a function of time, is shown for the second embodiment. The area identified as 70 is representative of maximum rates of change substantially necessary to maintain combustion stability, measured in cam angle degrees per second, for the first variable cam phaser, over the range of test conditions mentioned previously. The area identified as 75 is representative of maximum rates of change substantially necessary to maintain combustion stability, measured in cam angle degrees per second, for the second variable cam phaser; over the range of test conditions mentioned previously. A line 80 is identified to be the initial rate of change substantially necessary to maintain combustion stability, for the second embodiment. A calibration representing the values of the line 80 is included in the controller 10 for this embodiment as the initial rate of change of the variable cam phasing system substantially necessary to maintain combustion stability. Calibration of the controller is known to one skilled in the art.

Although the invention is described as a vane-type variable cam phasing system, it is understood that alternate embodiments of this invention includes other variable cam phasing systems, e.g. a spline-type phaser. It is also understood that the invention encompasses all methods and apparatus for controlling the variable valve system on an internal combustion engine, regardless of the configuration of the engine. It is also understood that the invention encompasses all applications of internal combustion engines, including over-the-road vehicles, off-road vehicles, farm equipment, and stationary engines. It is also understood that alternate embodiments of the invention includes other engine sensors, other methods for determining engine performance, and other engine output devices, insofar as they come within the scope of the invention. It is also understood that alternate embodiments of the invention may include other methods and means of determining combustion stability and engine operating points.

The invention has been described with specific reference to the preferred embodiments and modifications thereto. Further modifications and alterations may occur to others upon reading and understanding the specification. It is intended to include all such modifications and alterations insofar as they come within the scope of the invention.

What is claimed is:

1. A method of controlling a variable cam phasing system of an internal combustion engine during transient engine operation, comprising:

determining a rate of change of the variable cam phasing system substantially necessary to maintain combustion stability;

monitoring an operating point of the engine;

determining a desired operating point of the engine; and, controlling the rate of change of the variable cam phasing system based upon the operating point of the engine, the desired operating point of the engine, and the rate of change of the variable cam phasing system substantially necessary to maintain combustion stability during transient engine operation.

2. The method of claim 1, wherein monitoring an operating point of the engine comprises monitoring engine speed, engine load, and engine air/fuel ratio.

3. The method of claim 1, wherein determining a desired operating point of the engine comprises monitoring operator demand indicated by an accelerator position and a cruise control.

4. A method of controlling a variable cam phasing system of an internal combustion engine, comprising:

determining an initial rate of change of the variable cam phasing system necessary to maintain combustion stability based upon a coefficient of variation of mean effective pressure for the internal combustion engine;

monitoring an operating point of the engine;

determining a desired operating point of the engine; and, controlling rate of change of the variable cam phasing system based upon the operating point of the engine, the desired operating point of the engine, and the initial rate of change of the variable cam phasing system substantially necessary to maintain combustion stability based upon a coefficient of variation of mean effective pressure for the internal combustion engine.

5. A method of controlling a variable cam phasing system of an internal combustion engine, comprising:

determining an initial rate of change of the variable cam phasing system based upon a coefficient of variation of mean effective pressure and exhaust emissions of the internal combustion engine;

monitoring an operating point of the engine;

determining a desired operating point of the engine; and, controlling rate of change of the variable cam phasing system based upon the operating point of the engine, the desired operating point of the engine, and the initial rate of change of the variable cam phasing system based upon the coefficient of variation of mean effective pressure and exhaust emissions of the internal combustion engine.

6. The method of claim 5, further comprising adjusting the initial rate of change of the variable cam phasing system based upon an index of combustion stability.

7. The method of claim 6, wherein the index of combustion stability comprises a measure of engine speed variation determined during ongoing engine operation.

8. A system for controlling a variable cam phasing system of an internal combustion engine during transient engine operation, comprising:

a controller operable to:

monitor an operating point of the engine, and, determine a desired operating point of the engine;

wherein the controller controls a rate of change of the variable cam phasing system during transient engine operation based upon the operating point of the engine, the desired operating point of the engine, and a rate of change of the variable cam phasing system substantially necessary to maintain combustion stability.

9. The system of claim 8, wherein the internal combustion engine is an in-line cylinder configuration.

10. The system of claim 8, wherein the internal combustion engine is configured as a dual bank of cylinders.

11. A method of controlling a variable cam phasing system of an internal combustion engine, comprising:

determining an initial rate of change of the variable cam phasing system based upon exhaust emissions of the internal combustion engine;

monitoring an operating point of the engine;

determining a desired operating point of the engine; and, controlling rate of change of the variable cam phasing system based upon the operating point of the engine, the desired operating point of the engine, and the initial rate of change of the variable cam phasing system based upon the exhaust emissions of the internal combustion engine.

* * * * *